US012758041B2

(12) United States Patent
Lambert et al.

(10) Patent No.: US 12,758,041 B2
(45) Date of Patent: Oct. 13, 2026

(54) SEALABLE STRAW FOR BEVERAGE CONTAINER

(71) Applicant: Pacific Market International, LLC, Seattle, WA (US)

(72) Inventors: Kimberly Lambert, Seattle, WA (US); Michael Beckman, Seattle, WA (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

(21) Appl. No.: 19/165,015

(22) PCT Filed: Mar. 14, 2024

(86) PCT No.: PCT/US2024/020010
§ 371 (c)(1),
(2) Date: Sep. 12, 2025

(87) PCT Pub. No.: WO2024/192293
PCT Pub. Date: Sep. 19, 2024

(65) Prior Publication Data

US 2026/0137225 A1 May 21, 2026

Related U.S. Application Data

(60) Provisional application No. 63/490,446, filed on Mar. 15, 2023.

(51) Int. Cl.
*A47G 19/22* (2006.01)

(52) U.S. Cl.
CPC ..... *A47G 19/2272* (2013.01)

(58) Field of Classification Search
CPC ..... A47G 19/2272; A47G 19/2266; A47G 21/18; B65D 47/242; B65D 47/06; B65D 2543/00046; A45F 3/16; A45F 3/18
(Continued)

(56) References Cited

U.S. PATENT DOCUMENTS 4,428,508 A * 1/1984 Gardikas ..... A47G 19/2266 222/211
D310,781 S 9/1990 Scott, III
(Continued)

FOREIGN PATENT DOCUMENTS

EP 015033949-0001 9/2023
KR 3020160001611 11/2016
(Continued)

OTHER PUBLICATIONS

COKTIK 20oz Insulated Tumbler with Lid and Straw, posted May 22, 2024 [online], [retrieved Oct. 31, 2024]. Retrieved from internet, https://www.amazon.com/dp/BOD4V1 KDV3/ref=sspa_dk_detail_ 1 ?pf_rd_p=c4606765-78ec-444e-9319-716ceb6c5a61 &pf_rd_r= GKQ9CJC9TFDFS%E2%80%A6 (Year: 2024).
(Continued)

*Primary Examiner* — Steven A. Reynolds
(74) *Attorney, Agent, or Firm* — Merchant & Gould P.C.

(57) ABSTRACT

A container lid including a lid body defining a central chamber, the lid body further including a hollow threaded shaft in the central chamber, the hollow threaded shaft including a plug, a dial rotatably engaged with the lid body, wherein the dial includes a neck extending into the central chamber and surrounding the threaded shaft, and wherein the dial is positionable in a first position and in a second position, an upper straw threadably engaged with the hollow threaded shaft and slidably engaged with the neck of the dial, and wherein the upper straw defines an inlet, and wherein when the dial is in the first position, the plug is disengaged from the inlet of the upper straw and wherein when the dial is in the second position, the plug is engaged with the inlet of the upper straw, and a lower straw fluidically coupled to the hollow threaded shaft.

16 Claims, 9 Drawing Sheets

(58) Field of Classification Search
USPC ..... 220/711, 714, 715, 705, 707; 215/229, 215/388; 222/518
See application file for complete search history.

(56) References Cited

U.S. PATENT DOCUMENTS

| | | | | |
|---|---|---|---|---|
| 5,513,762 | A * | 5/1996 | Janani | B65D 77/283 215/229 |
| D585,245 | S | 1/2009 | Brouillette | |
| D591,106 | S | 4/2009 | Dominique et al. | |
| D648,985 | S | 11/2011 | Chiu et al. | |
| D688,521 | S | 8/2013 | Lees | |
| D721,920 | S | 2/2015 | Coon et al. | |
| D732,338 | S | 6/2015 | Boroski | |
| D740,073 | S | 10/2015 | Zorovich et al. | |
| D769,069 | S | 10/2016 | Sanbar | |
| D799,272 | S | 10/2017 | Pisarevsky | |
| D804,907 | S | 12/2017 | Sandoval | |
| D805,847 | S | 12/2017 | Sandoval | |
| D838,140 | S | 1/2019 | Furneaux et al. | |
| 10,322,855 | B2 * | 6/2019 | Heiberger | B65D 47/2031 |
| D855,390 | S | 8/2019 | Lullie et al. | |
| D891,866 | S | 8/2020 | Ames | |
| D927,935 | S | 8/2021 | Ames | |
| D946,346 | S | 3/2022 | Pape et al. | |
| D1,011,835 | S | 1/2024 | Hazelton | |
| D1,015,063 | S | 2/2024 | Pape et al. | |
| D1,019,264 | S | 3/2024 | Pape et al. | |
| D1,031,376 | S | 6/2024 | Xu | |
| D1,044,405 | S | 10/2024 | Wang-Wu | |
| 2018/0050844 | A1 * | 2/2018 | Hirst | A47G 19/2266 |
| 2020/0085217 | A1 * | 3/2020 | Heiberger | B65D 51/24 |
| 2020/0339314 | A1 * | 10/2020 | Meyers | B65D 47/263 |
| 2025/0033854 | A1 * | 1/2025 | Jacob | A47G 19/2222 |
| 2025/0074683 | A1 * | 3/2025 | Shi | A45F 3/16 |
| 2025/0304335 | A1 * | 10/2025 | Wang | A47G 19/2272 |
| 2026/0083266 | A1 * | 3/2026 | Mammoser | A47G 21/183 |
| 2026/0145853 | A1 * | 5/2026 | Hua | B65D 51/245 |

FOREIGN PATENT DOCUMENTS

| | | |
|---|---|---|
| KR | 301058585 S | 5/2020 |
| WO | D091354-002 | 3/2016 |
| WO | D244911-001 | 12/2024 |

OTHER PUBLICATIONS

FrostBuddy_ To-Go Buddy, posted Apr. 28, 2024 [online], [retrieved Oct. 28, 2024]. Retrieved from internet, https://frostbuddy.com/products/to-go-buddy-lemongrass (Year: 2024).

Hydrapeak Traveler 25oz Insulated Tumbler, posted Sep. 20, 2022 [online], [retrieved Oct. 31, 2024]. Retrieved from internet, https:// www.amazon.com/Hydrapeak-Traveler-Insulated-Tu m bler-Straw/ dp/B0 B Fzf Lb P ??th= 1 (Year: 2022).

International Search Report and Written Opinion for PCT/US2024/ 020010, mailed Jul. 1, 2024.

Thermos 18 Ounce Vacuum Insulated Cold Cup with Straw, posted Mar. 20, 2015 [online], [retrieved Oct. 31, 2024]. Retrieved from internet, https://www.amazon.com/Thermos-Ounce-Vacuu m-Insulated-Straw/dp/B00VAG850A ?th= 1 (Year: 2015).

Seafoam Stainless Steel Vacuum Cold Cup, posted Jan. 3, 2024 [online], [retrieved Oct. 28, 2024]. Retrieved from internet, https :// about. starbucks. co m/press/2024/sh i ne-i n-the-new-year -with-starbucks-new-winter-merchandise/ (Year: 2024).

Starbucks_tiktok_ 4rayahsunchine, posted May 27, 2023 [online], [retrieved Oct. 28, 2024]. Retrieved from internet, https://www. tiktok.com/@4rayah.sunshine/video/7237973723511344430?1ang= en (Year: 2023).

* cited by examiner

SEALABLE STRAW FOR BEVERAGE CONTAINER

CROSS-REFERENCE TO RELATED APPLICATION

This application is a National Stage Application of PCT/US2024/020010 filed Mar. 14, 2024, which claims the benefit of and priority to U.S. Provisional Application No. 63/490,446, filed Mar. 15, 2023, which applications are hereby incorporated herein by reference. To the extent appropriate, a claim of priority is made to each of the above-disclosed applications.

BACKGROUND

A beverage container typically has a lid and a straw inserted in the lid to facilitate drinking of the beverage without having to open the lid and risk spilling the beverage. The straw, however, may allow the beverage contained in the container to spill therethrough when the container is, e.g., moved or tilted. In addition, the material of the straw may deteriorate upon repeated use thereof.

SUMMARY

In an aspect, the technology relates to a container lid including a lid body defining a central chamber, the lid body further including a hollow threaded shaft disposed in the central chamber, wherein the hollow threaded shaft includes a plug, a dial rotatably engaged with the lid body, wherein the dial includes a neck extending into the central chamber and substantially surrounding the hollow threaded shaft, and wherein the dial is positionable in at least a first position and in a second position, an upper straw threadably engaged with the hollow threaded shaft and slidably engaged with the neck of the dial, wherein the upper straw defines an inlet, and wherein when the dial is in the first position, the plug is disengaged from the inlet of the upper straw, and when the dial is in the second position, the plug is engaged with the inlet of the upper straw, and a lower straw fluidically coupled to the hollow threaded shaft.

In another example of the above aspect, the container lid further includes a gasket disposed around the upper straw, wherein the gasket is between an inner surface of the neck of the dial and an outer surface of the upper straw. In other examples, the lid body includes a centrally disposed platform, and the dial is matingly engaged with an outside surface of the platform. For example, a portion of the platform constitutes the hollow threaded shaft. As another example, the platform and the hollow threaded shaft are integrally formed. For example, the platform includes a perimeter lip. In other examples, the container lid further includes threaded projections on an outside surface of the lid body, the threaded projections being adjacent to the perimeter lip. In a further example, the dial includes a recessed portion therein, and the platform includes a raised portion facing the recessed portion of the dial. For example, when the recessed portion of the dial and the raised portion of the platform are adjacent to one another in an axial direction of the upper straw, the upper straw is sealed, and when the recessed portion of the dial and the raised portion of the platform are separated from each other by a distance in the axial direction of the upper straw, the upper straw is open. For example, a degree to which the upper straw is open is proportional to the distance separating the recessed portion of the dial and the raised portion of the platform in the axial direction.

In other examples, the upper straw includes a plurality of first threaded projections at an inner surface thereof, and the hollow threaded shaft includes a plurality of second threaded projections at an outer surface thereof, the second threaded projections being in a rotational mating configuration with the first threaded projections. For example, a rotation of the dial causes the first threaded projections to rotate around the hollow threaded shaft, resulting in the upper straw being urged towards the plug of the hollow threaded shaft. In a further example, the upper straw, the hollow threaded shaft, and the lower straw are concentric. In yet another example, the dial includes a knurled outer surface.

In another aspect, the technology relates to a beverage container including a container body including an inner surface, an upper portion of the inner surface including a plurality of threaded recesses, a container lid according to the above description, the container lid including a plurality of threaded projections on an outside surface thereof, wherein the threaded recesses of the container body and the threaded projections of the container lid are in a mating configuration. In an example, a lower portion of the inner surface of the container body defines a hollow space configured to provide thermal insulation to an inside portion of the container body.

DETAILED DESCRIPTION

Figure 1A:
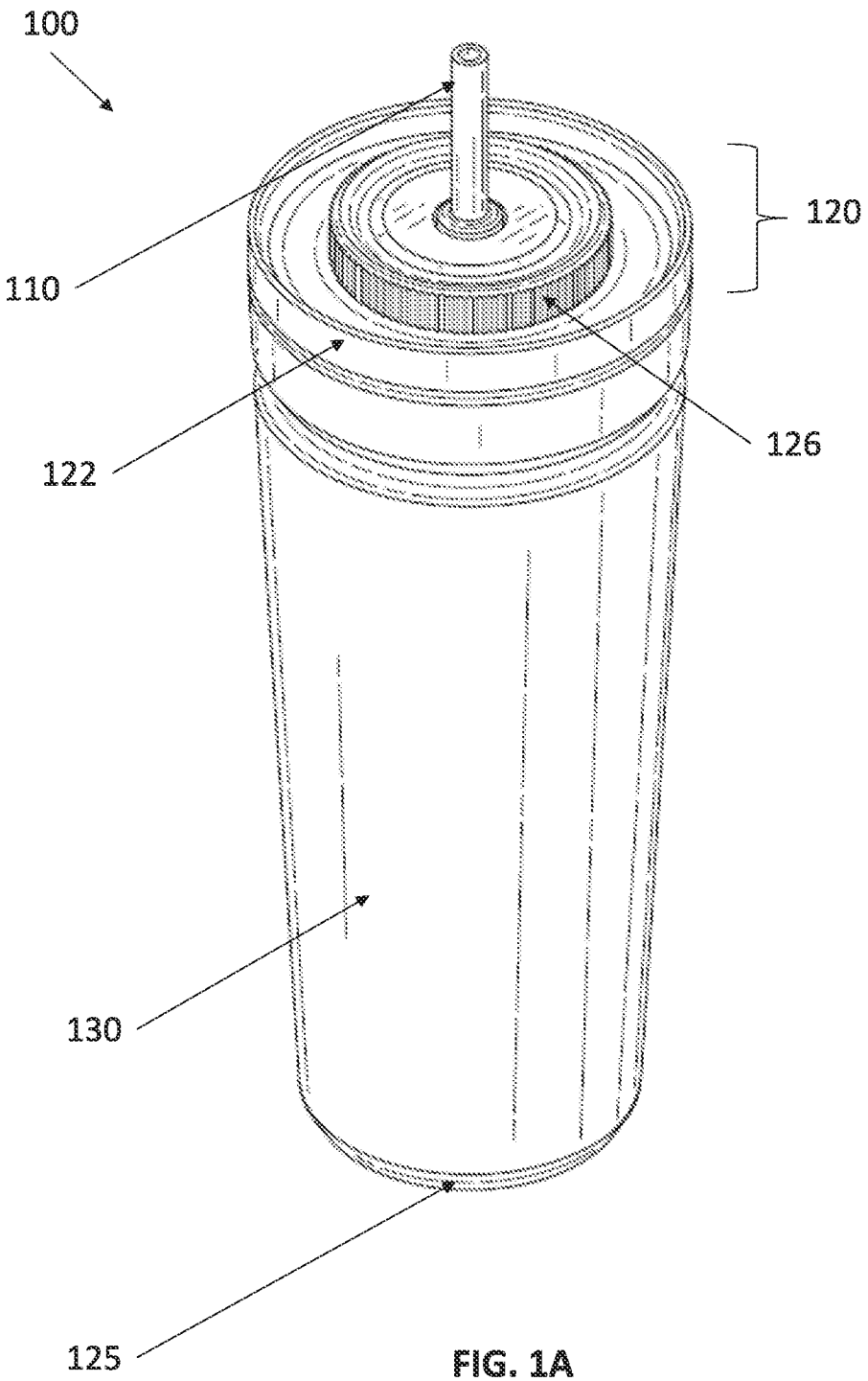
FIGS. 1A and 1B illustrate perspective views of a container having a container body and a container lid, according to various examples of the disclosure.

The technologies described herein relate to a lid for a beverage container. The lid includes a lid body and a lid upper portion that are configured to define a liquid flow path therein and restrict or prevent liquids from spilling out of the lid during container movement. Additionally, the lid upper portion is removably coupled to the lid body so that the lid may be easily disassembled in order to, e.g., facilitate cleaning.

Many components of the container lid may be referred to as having generally cylindrical, circular, annular, or conical features. Such features may be referred to, or defined by, a circumference, radius, external surface, internal surface, and/or other terms appropriate for defining such features. It should be noted that such features may alternatively be elliptical, polygonal, and the like. As used herein, the terms "axial" and "longitudinal" refer to directions and orientations which extend substantially parallel to a centerline of the lid. Moreover, the terms "radial" and "radially" refer to directions and orientations which extend substantially perpendicular to the centerline of the lid. In addition, as used herein, the terms "circumferential" and "circumferentially" refer to directions and orientations which extend arcuately about the centerline of the lid. A lid for a beverage container having a closeable straw is described herein. The container lid and closeable straw are structured so as to resist or prevent a beverage or liquid contained in the container from spilling out through the straw during movement or tilting of the container, or if a user attempts to consume the beverage or liquid through the straw.

This disclosure describes some examples of the present technology with reference to the accompanying drawings, in which only some of the possible examples were shown. Other aspects can, however, be embodied in many different forms and should not be construed as limited to the examples set forth herein. Rather, these examples were provided so that this disclosure was thorough and complete and fully conveyed the scope of the possible examples to those skilled in the art. Any number of the features of the different examples described herein may be combined into one single example and alternate examples having fewer than or more than all of the features herein described are possible. Further, as used herein and in the claims, the phrase "at least one of element A, element B, or element C" is intended to convey any of: element A, element B, element C, elements A and B, elements A and C, elements B and C, and elements A, B, and C. It is to be understood that terminology employed herein is used for the purpose of describing particular examples only and is not intended to be limiting. It must be noted that, as used in this specification, the singular forms "a," "an," and "the" include plural referents unless the context clearly dictates otherwise. Further, one having skill in the art will understand the degree to which terms such as "about" or "substantially" convey in light of the measurement techniques utilized herein. To the extent such terms may not be clearly defined or understood by one having skill in the art, the terms such as "about" or "substantially" shall mean plus or minus ten percent.

Figure 1B:
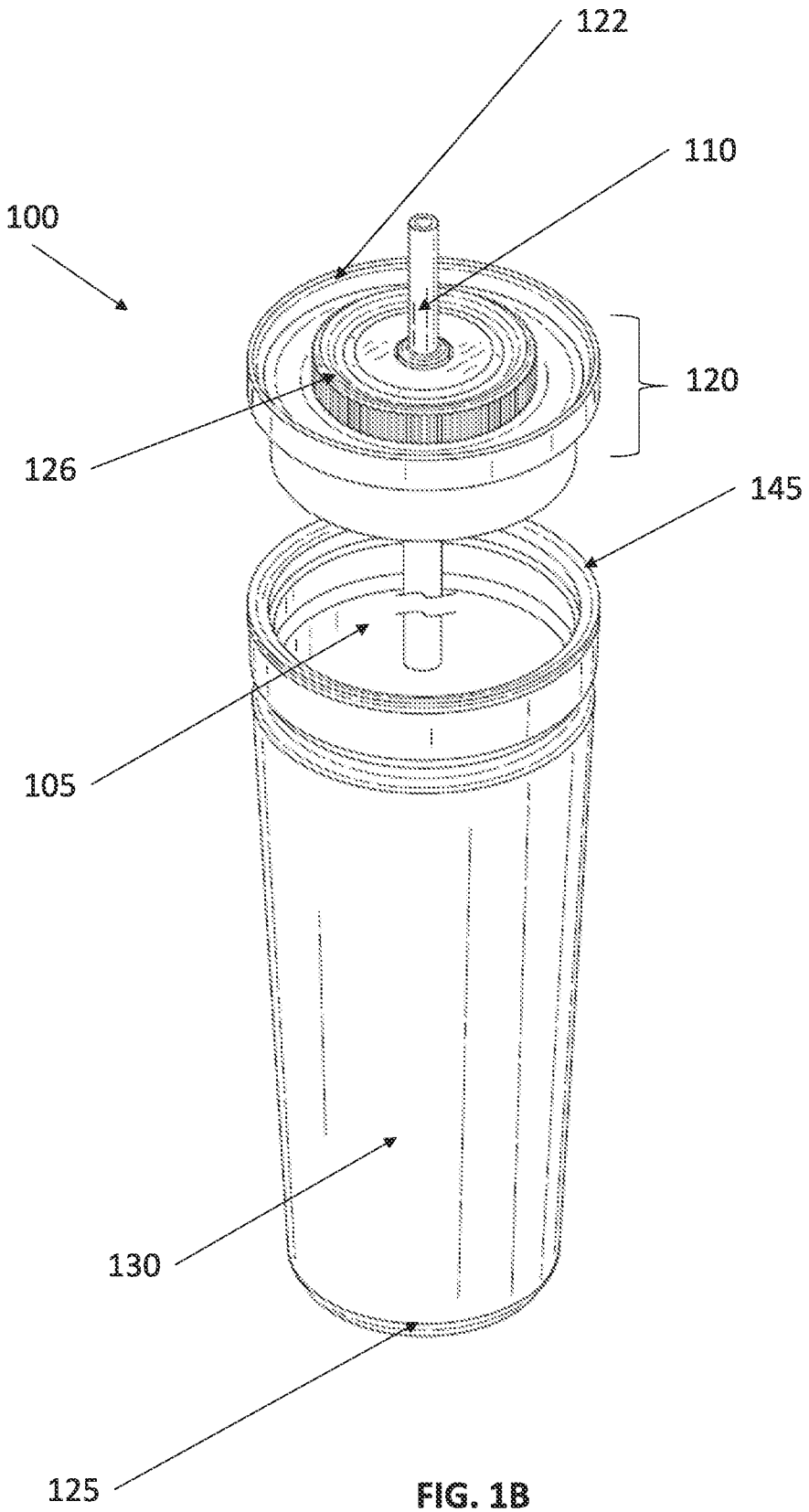

FIGS. 1A and 1B illustrate perspective views of a container having a container body and a container lid, according to various examples of the disclosure. FIGS. 1A and 1B are described concurrently and not every component described is depicted in every figure. With reference to FIGS. 1A and 1B, beverage container 100 includes a container body 130 and a container lid or lid body 120. The container lid 120 may include a dial 126 that includes a raised opening 110 such as, e.g., an upper straw 110, and a flared perimeter wall (i.e., rim or lip) 122. The dial 126 may have a knurled outer surface which may, e.g., facilitate a grip thereof. The beverage container 100 may further include a bottom portion 125 at an opposite end of the lid body 120, and the middle portion or container body 130 extending therebetween. The dial 126 may be rotatably coupled to the rest of the lid body 120, that is, the dial 126 is independently rotatable with respect to lid body 120, while remaining secured thereto. The dial 126 may be a raised structure to facilitate, e.g., being manipulated or rotated by, e.g., a machine or a user. In various examples, the beverage container 100 is illustrated as a drinking cup, but may alternatively take the form of a glass, mug, tumbler, goblet, stein, tankard, vessel, beaker, drinkware, beverageware, or other vessel for holding liquid beverages for consumption. In other examples, while the container 100 is described as being for liquids, the container 100 may be used for containing any other substances, materials, or items as required or desired that can be consumed through a straw.

With reference to FIG. 1B, the container body 130 defines an interior chamber 105 configured to hold a liquid or beverage therein. An upper end portion 145 of the container body 130 is open for access to the interior chamber 105, and the bottom or lower end portion 125 is closed to keep the liquid inside the container body 130. The interior chamber 105 in the container body 130 extends between the upper end portion 145 and the lower end portion 125. In the examples illustrated in at least FIGS. 1A and 1B, the container body 130 is substantially cylindrical in shape. In other examples, the container body 130 may have, e.g., a different cross-sectional shape or a tapered profile with the upper end portion 145 and the lower end portion 125 having different diameters. As illustrated, the container body 130 does not include a handle. In other examples, the container body 130 may include one or more handles as required or desired. In other examples, the container body 130 may be formed from stainless steel, or from glass, ceramics, plastics, and the like, or combinations thereof. In additional examples, the container body 130 may also be manufactured so as to provide insulation for the liquid contained therein from a surrounding environment.

Figure 2A:
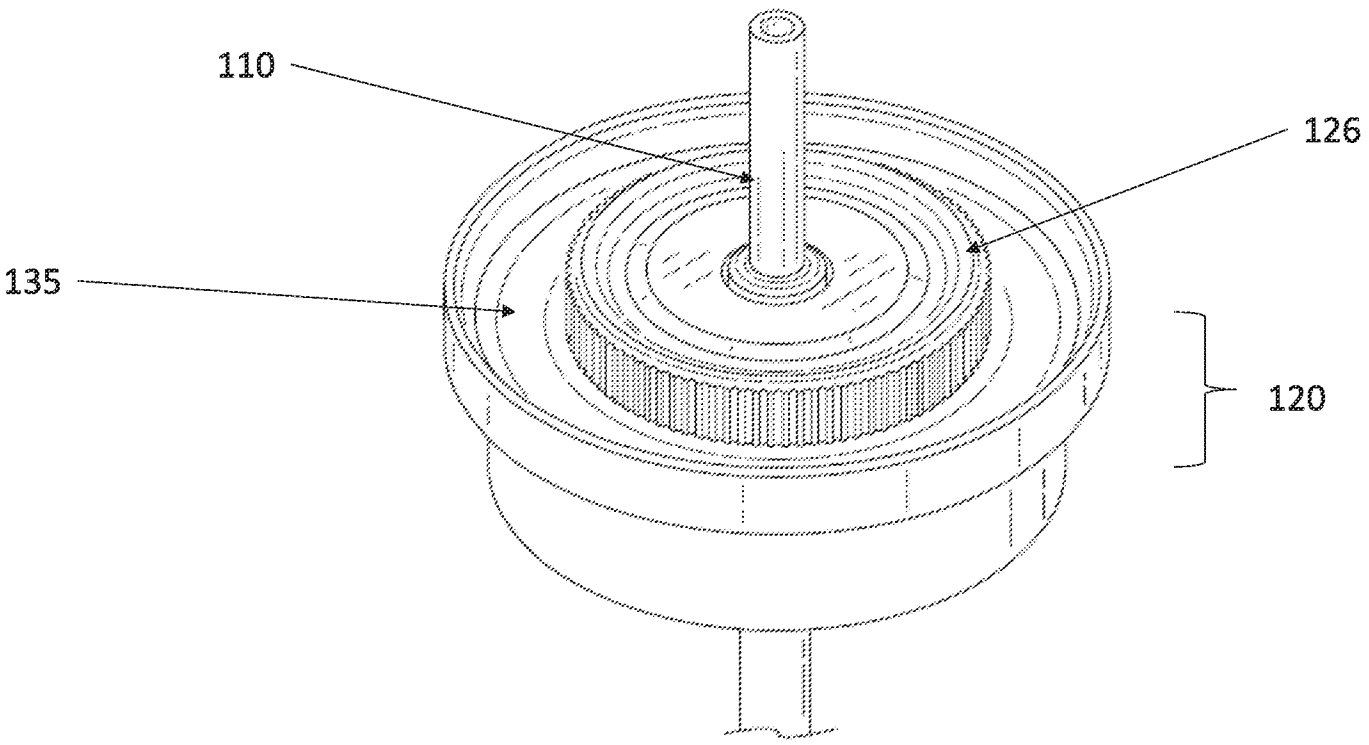
FIGS. 2A-2C illustrate perspectives view of a container lid, according to various examples of the disclosure.
Figure 2B:
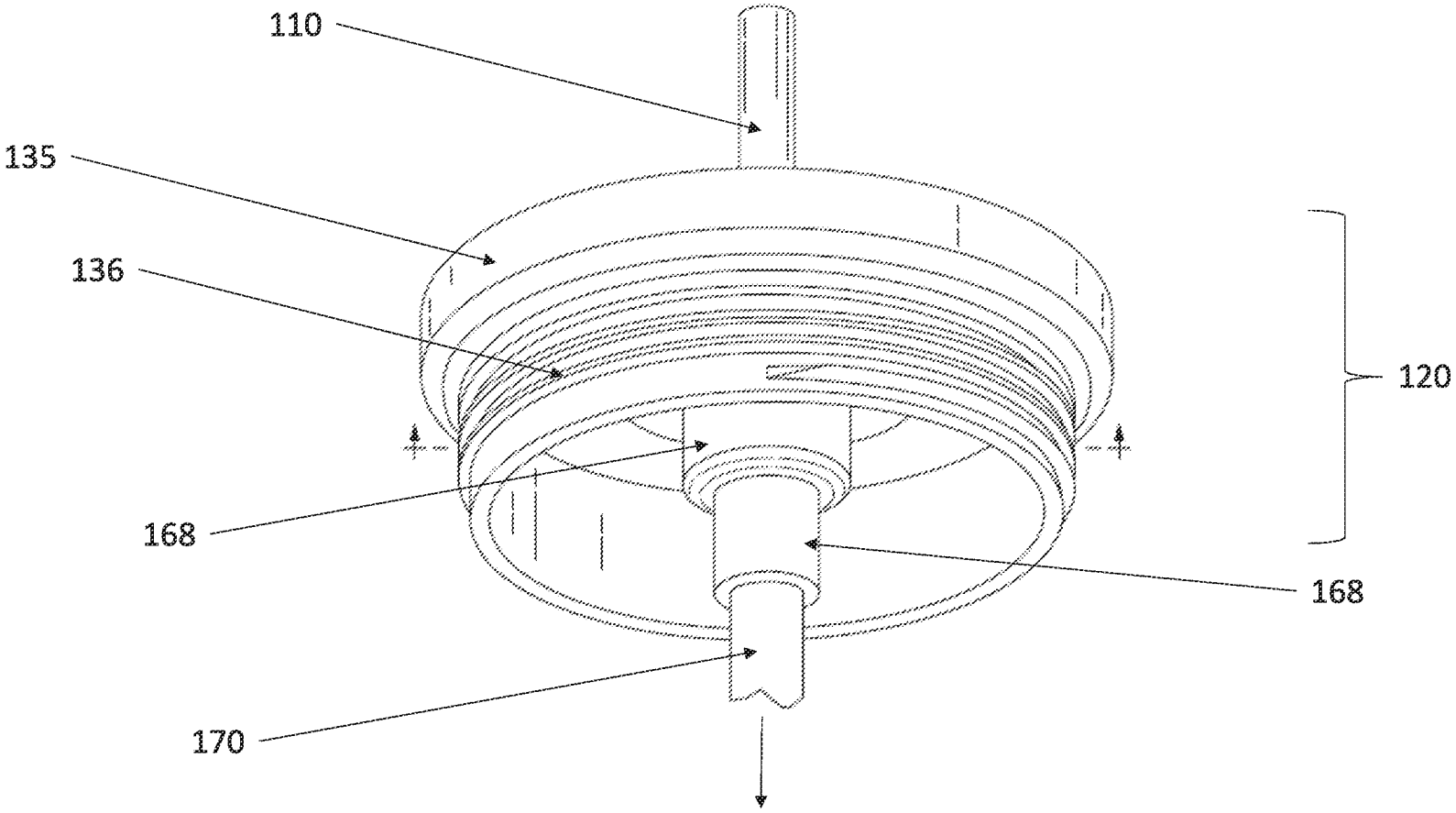
Figure 2C:
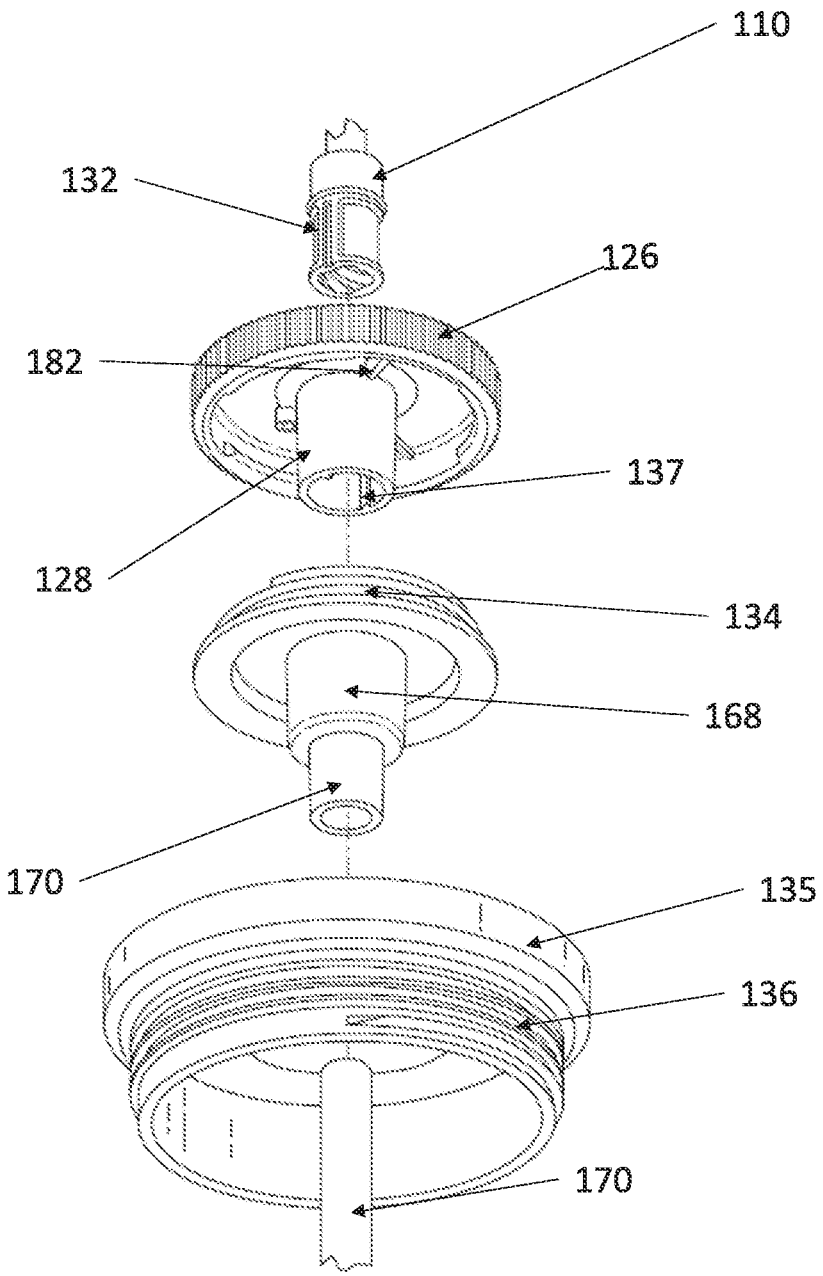

FIGS. 2A-2C illustrate perspective views of a container lid, according to various examples of the disclosure. FIGS. 2A-2C are described concurrently and not every component described is depicted in every figure. With reference to FIGS. 2A-2C, the upper straw 110 of the lid body 120 defines a fluid or liquid flow path therein for fluid or liquid to be removed from the container body 130 when the lid body 120 is coupled thereto. The lid body 120 includes a platform 135 configured to couple or seal the lid body 120 to a corresponding threaded portion of an inside surface of the container body 130 and therefore prevent any fluid or liquid from escaping from the beverage container 100. FIG. 2A illustrates an upper view of the lid body 120 including the platform 135 on which the dial 126 is rotatably coupled, and the upper straw 110 that forms a fluid path through the dial 126 and the platform 135. FIG. 2B illustrates a lower view of the lid body 120 which includes the platform 135, the upper straw 110, and a lower platform portion 168 of the platform 135. The platform 135 has a plurality of threaded projections 136 at a side surface thereof and the lower platform portion 168 is fluidly coupled to a lower straw 170. FIG. 2C illustrates the straw 110, the dial 126 having a neck 128, and the platform 135 having the lower platform portion 168 fluidly coupled to the lower straw 170, and first projections 134 at an upper side thereof and second threaded projections 136 at a lower side thereof. FIG. 2C further illustrates a stop 182 configured to engage with a corresponding stop (illustrated in FIGS. 3A and 3B as stop 184) of the platform 135. FIG. 2C also illustrates a recess 132 formed in the side of the upper straw 110, the recess 132 being configured to slide with respect to a corresponding projection 137 formed on an inside surface of the neck 128 of the dial 126.

Figure 3A:
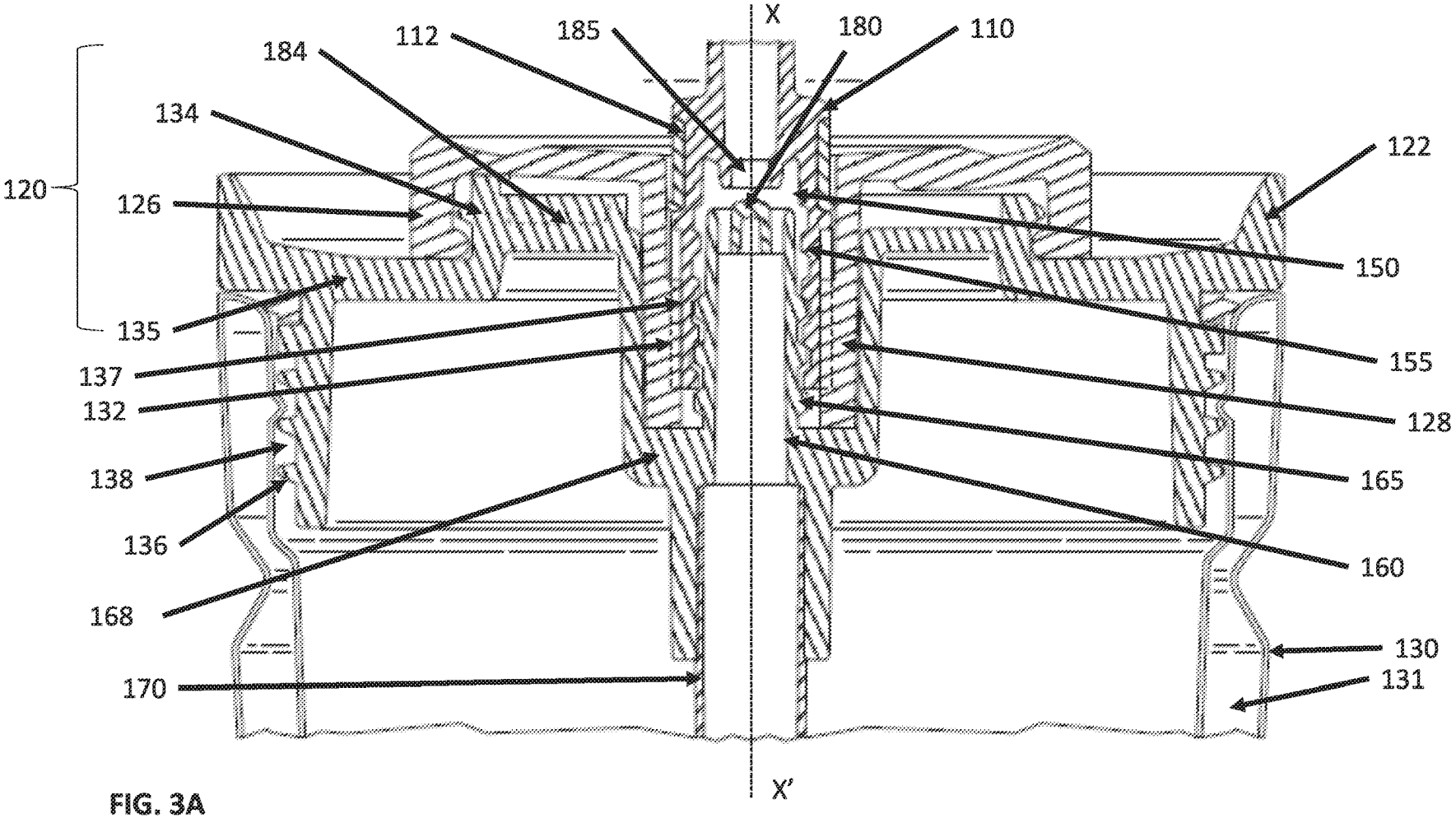
FIGS. 3A and 3B illustrate cross-sections of a container lid in operation, according to various examples of the disclosure.
Figure 3B:
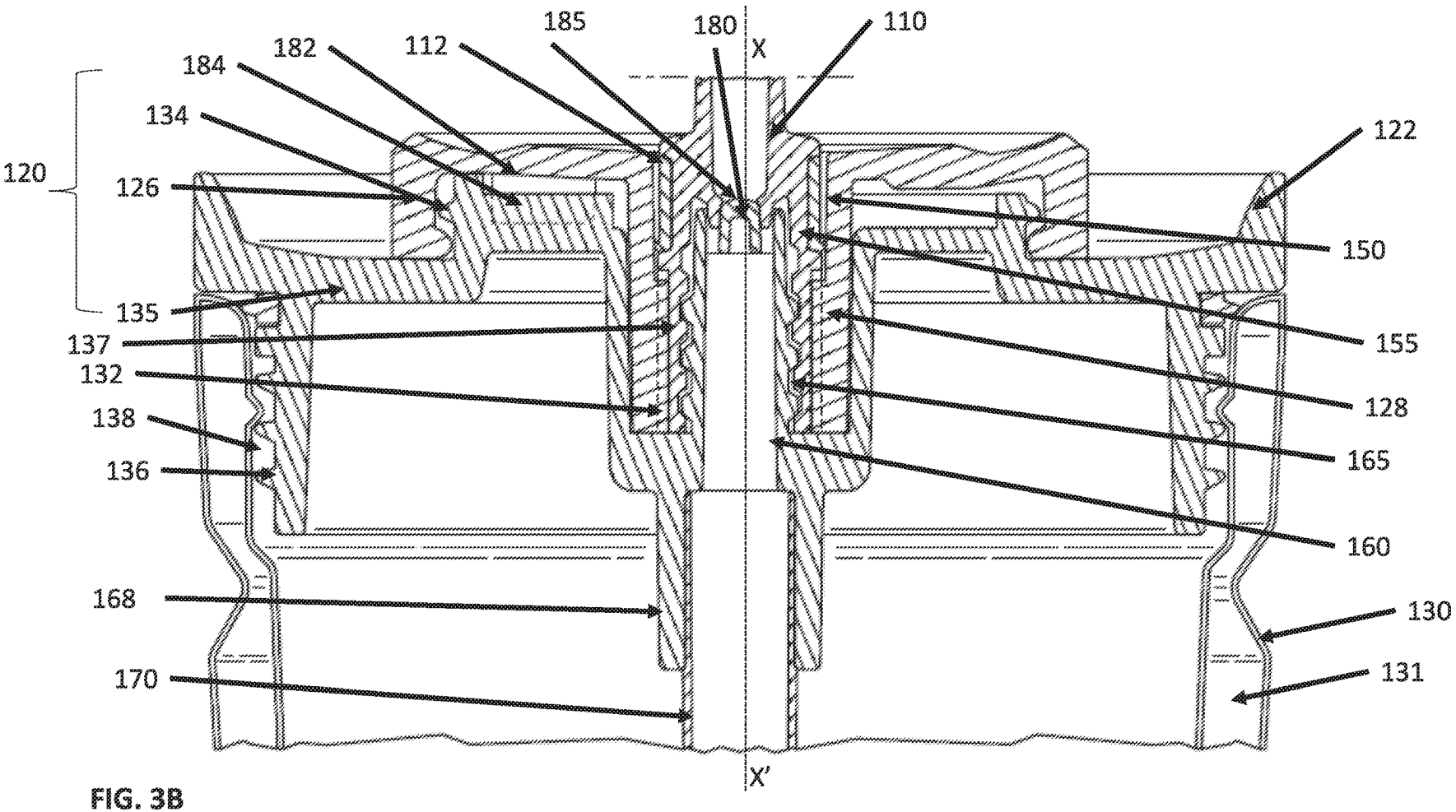

FIGS. 3A and 3B illustrate cross-sections of a container lid in operation, according to various examples of the disclosure. In FIG. 3A, the lid body 120 includes perimeter rim or lip 122, a central chamber 150 defined within the upper straw 110, and a hollow threaded shaft 160 disposed in the central chamber 150, wherein the hollow threaded shaft 160 includes a plug 180 at an upper end thereof. The hollow threaded shaft 160 defines a hollow cylinder therein, which enables passage of liquid through the lower platform portion 168 and the lower straw 170. The lid body 120 further includes a dial 126, and the dial 126 is disposed about the upper straw 110 and includes the neck 128 which substantially surrounds a lower portion of the upper straw 110 and the hollow threaded shaft 160. The dial 126 may be positionable in a first disengaged position and in a second engaged position, as further discussed below. The upper straw 110 includes a plurality of threaded projections 155 on an inner surface thereof, and is threadably engaged with threaded projections 165 of an outside surface of the hollow threaded shaft 160. The upper straw 110 also includes at least one recess 132 that is slidably engaged with a projection 137 of the neck 128 of the dial 126.

The upper straw also 110 defines an inlet 185 at a bottom portion thereof. When the dial is in the first position (as depicted in FIG. 3A), the plug 180 of the hollow threaded shaft 160 is disengaged from the inlet 185 of the upper straw 110, e.g., the plug 180 is at a distance from the inlet 185. When the dial 126 is in the second position (as depicted in FIG. 3B), the plug 180 is engaged with the inlet 185 of the upper straw 110, e.g., the plug 180 is in contact with the inlet 185. The plug 180 may have substantially the same size as the inlet 185 of the straw 110. Accordingly, although a liquid or beverage may travel in and out of the container when the inlet 185 is disengaged with the plug 180, liquid or beverage may be prevented from traveling from the hollow threaded shaft 160 and into the upper straw 110 when the inlet 185 is engaged with the plug 180. The upper straw 110 and the central chamber 150 of the dial 126 may be located at a center portion of the dial 126. The lid body 120 also includes a gasket 112 between an outer surface of the upper straw 110 and an inner surface of the neck 128 of the dial 126 to prevent leakage of the beverage or liquid.

The platform 135 of the lid body 120 that surrounds the hollow threaded shaft 160 within the central chamber 150 of the dial 126 may be centrally disposed, and the dial 126 is matingly engaged with the platform 135 via the first projections 134 of the platform 135. A lower platform portion 168 of the platform 135 may surround the hollow cylinder or lower straw 170 at a bottom portion thereof, the hollow cylinder or lower straw 170 being fluidly coupled to the hollow threaded shaft 160 and extending into the beverage container body 130. The container body 130 may include a hollow portion 131 configured to provide thermal insulation to the liquid or beverage stored therein. FIG. 3A shows that the hollow cylinder 170, the hollow threaded shaft 160, the central chamber 150 and the upper straw 110 are in fluid communication with each other, and are concentric along axis X-X'.

As indicated above, the threaded projections 155 of the upper straw 110 are in a mating configuration with the threaded projections 165 of the hollow threaded shaft 160, e.g., in a rotational mating configuration where, upon rotation of the dial 126, the threaded projections 155 rotate the threaded projections 165, which result in a movement of the upper straw 110 downward towards the plug 180 such that the inlet 185 of the upper straw 110 engages, or comes in contact, with the plug 180. When the plug 180 is in contact with the inlet 185, the inlet 185 is sealed, as further illustrated in FIG. 3B.

FIG. 3B illustrates a configuration where the straw 110 is sealed. The dial 126 may include a stop 182 that may engage with a stop 184 of the platform 135, where when the stops 182 and 184 come in contact with each other, as further illustrated in FIGS. 4A and 4B, the inlet 185 is engaged with the plug 180 and the upper straw 110 is sealed. In operation, when the dial 126 is rotated, the threaded projections 155 of the inner surface of the upper straw 110 rotate, and by being in a mating configuration with the threaded projections 165 of the hollow threaded shaft 160, cause the threaded projections 165 to rotate as well. As a result of the rotation of the threaded projections 155, the straw 110 is urged downwards in the direction of the hollow threaded shaft 160 until the plug 180, which is located on top of the hollow threaded shaft 160, engages with, or comes in contact with, the inlet 185 of the straw 110. When the plug 180 is in contact with the inlet 185, as illustrated in FIG. 3B, the plug 180 effectively closes the inlet 185 by blocking any liquid from transferring therethrough, and any liquid present in any of the hollow threaded shaft 160, the hollow cylinder 170, or the beverage container body 130 is effectively prevented from entering the straw 110. In addition, the gasket 112 that is between the upper straw 110 and the dial 126 ensures that the straw 110 is substantially sealed when the inlet 185 is engaged with the plug 180. The plug 180 has a solid upper portion configured to close the inlet 185 of the straw 110 when in contact therewith. The plug 180 may also have a hollow raised shape so as to allow fluid or liquid to flow from the hollow threaded shaft 160 upwards and into the straw 110 when the plug 180 is disengaged from the inlet 185. In an example, the platform 135 includes threaded projections 136 such that, e.g., the platform 135 may be coupled to the container body 130 via a threaded arrangement where, e.g., the threaded projections 136 from the platform 135 are in a mating configuration with corresponding threaded recesses 138 of an inside surface of the container body 130.

Figure 4A:
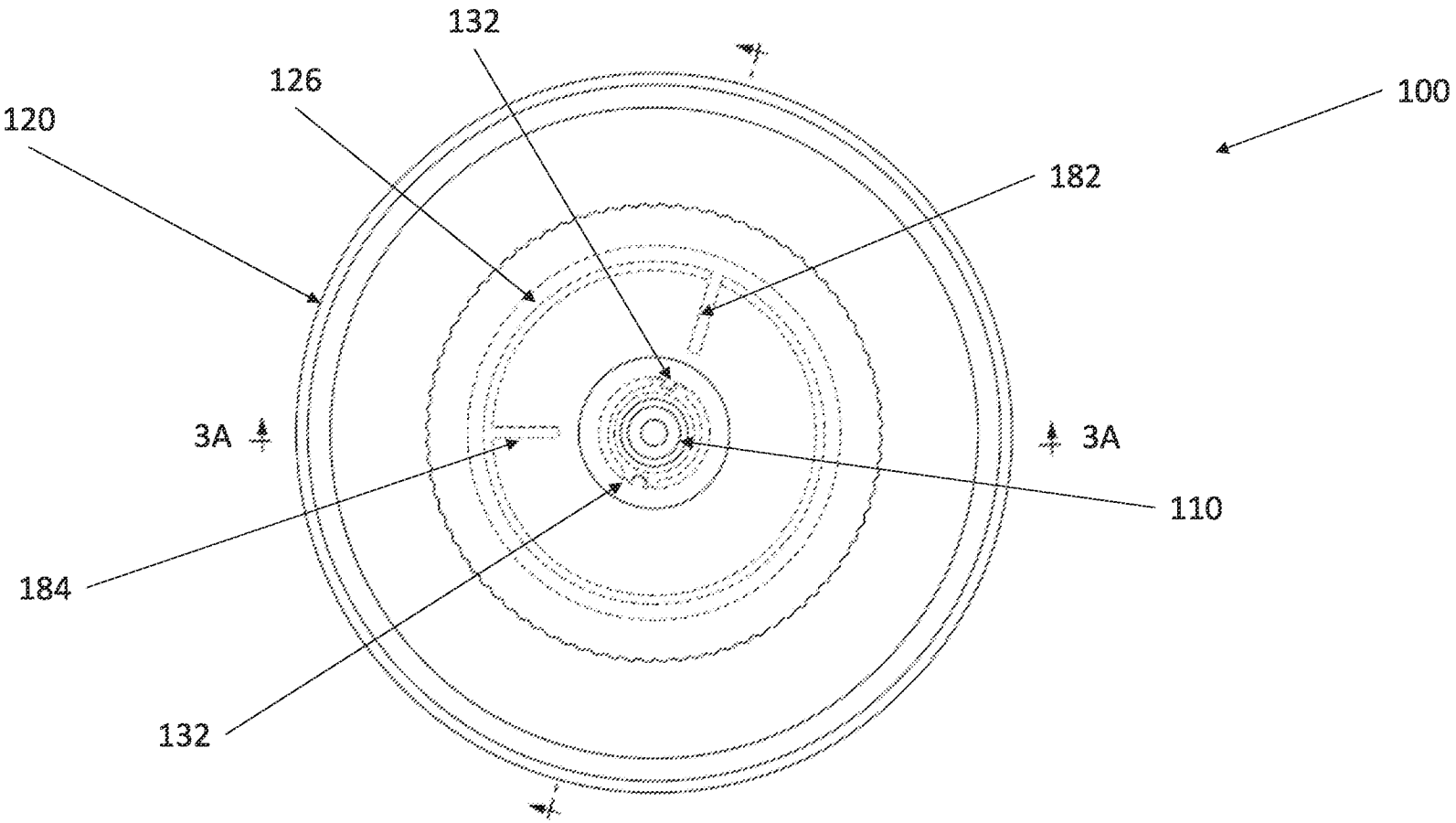
FIGS. 4A and 4B illustrate top views of a container lid during operation, according to various examples of the disclosure.
Figure 4B:
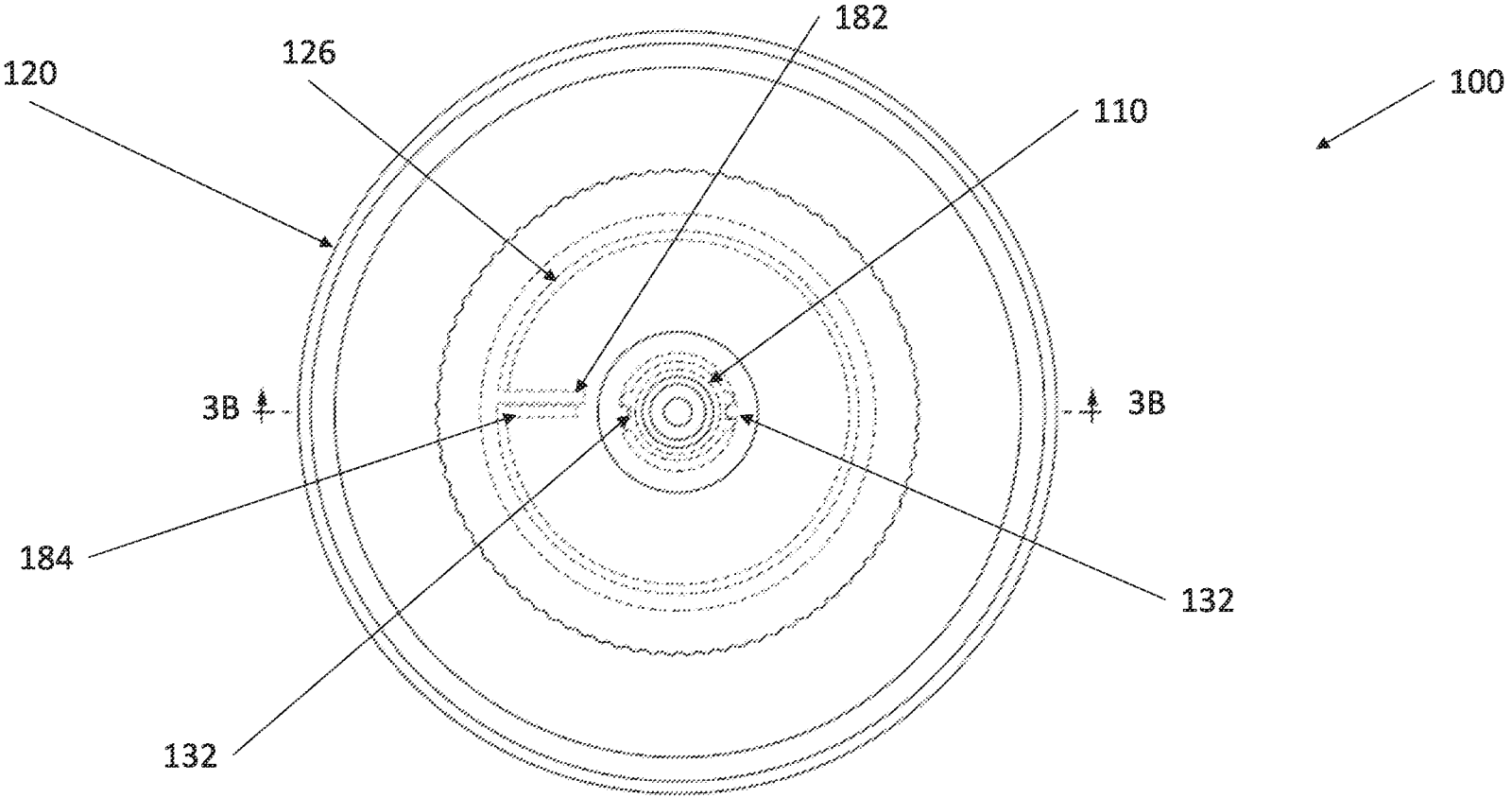

FIGS. 4A and 4B illustrate a top view of a container lid 100 during operation, according to various examples of the disclosure. FIGS. 4A and 4B illustrate top views of the lid body 120, the dial 126, and the straw 110 in both an open configuration illustrated in FIG. 4A and in a sealed configuration illustrated in FIG. 4B. Components of the container lid 100 located below the dial 126 are depicted in dashed lines. FIG. 4A illustrates an open configuration, e.g., the straw 110 being open, where stops 182 and 184 are separated from each other in a radial direction of the dial 126. With reference to FIG. 3A, the plug 180 is a distance from the inlet 185 of the straw 110 along the X-X' axis, thus leaving the inlet 185 open and allowing a liquid or beverage held in the container 130 to be transferred out through the upper straw 110. This open configuration is indicated by the stops 182 and 184 being separated from one another in a radial direction of the dial 126 by a given radial distance, as illustrated in FIG. 4A. The radial distance separating stops 182 and 184 may be an indicator of the degree to which the upper straw 110 is open. For example, and with reference to FIG. 3A, the larger the radial distance between the stops 182 and 184, the larger the distance separating the plug 180 from the inlet 185, and the more the upper straw 110 is open. FIGS. 4A and 4B also illustrate the sliding recesses 132 formed in the upper straw 110 which are configured to receive the projection 137 illustrated in FIG. 2C formed in the neck 128 of the dial 126.

The lid body 120 illustrated in FIG. 4B is in a sealed configuration, e.g., the opening of the straw 110 being sealed, indicated by the stops 182 and 184 being adjacent to, or in contact with, one another in a radial direction of the dial 126. With reference to FIG. 3B, the configuration of FIG. 4B corresponds to the plug 180 being in direct contact with the inlet 185 of the upper straw 110, thus closing the inlet 185 and preventing any liquid or beverage held in the container body 130 from transferring out through the upper straw 110.

Although specific examples were described herein, the scope of the technology is not limited to those specific examples. One skilled in the art will recognize other examples or improvements that are within the scope of the present technology. Therefore, the specific structure, acts, or media are disclosed only as illustrative examples. Examples according to the technology may also combine elements or components of those that are disclosed in general but not expressly exemplified in combination, unless otherwise stated herein. The scope of the technology is defined by the following claims and any equivalents therein.

What is claimed is:

1. A container lid comprising:

a lid body defining a central chamber, the lid body further comprising a hollow threaded shaft disposed in the central chamber, wherein the hollow threaded shaft comprises a plug;

a dial rotatably engaged with the lid body, wherein the dial comprises a neck extending into the central chamber and substantially surrounding the hollow threaded shaft, and wherein the dial is positionable in at least a first position and in a second position;

an upper straw threadably engaged with the hollow threaded shaft and slidably engaged with the neck of the dial, wherein the upper straw defines an inlet, and wherein when the dial is in the first position, the plug is disengaged from the inlet of the upper straw, and when the dial is in the second position, the plug is engaged with the inlet of the upper straw; and a lower straw fluidically coupled to the hollow threaded shaft.

2. The container lid of claim 1, further comprising a gasket disposed around the upper straw, wherein the gasket is between an inner surface of the neck of the dial and an outer surface of the upper straw.

3. The container lid of claim 1, wherein the lid body comprises a centrally disposed platform, and wherein the dial is matingly engaged with an outside surface of the platform.

4. The container lid of claim 3, wherein a portion of the platform constitutes the hollow threaded shaft.

5. The container lid of claim 4, wherein the platform and the hollow threaded shaft are integrally formed.

6. The container lid of claim 3, wherein the platform comprises a perimeter lip.

7. The container lid of claim 6, further comprising threaded projections on an outside surface of the lid body, the threaded projections being adjacent to the perimeter lip.

8. The container lid of claim 3, wherein:

the dial comprises a recessed portion therein; and the platform comprises a raised portion facing the recessed portion of the dial.

9. The container lid of claim 8, wherein:

when the recessed portion of the dial and the raised portion of the platform are adjacent to one another in an axial direction of the upper straw, the upper straw is sealed; and when the recessed portion of the dial and the raised portion of the platform are separated from each other by a distance in the axial direction of the upper straw, the upper straw is open.

10. The contained lid of claim 9, wherein a degree to which the upper straw is open is proportional to the distance separating the recessed portion of the dial and the raised portion of the platform in the axial direction.

11. The container lid of claim 1, wherein:

the upper straw comprises a plurality of first threaded projections at an inner surface thereof; and the hollow threaded shaft comprises a plurality of second threaded projections at an outer surface thereof, the second threaded projections being in a rotational mating configuration with the first threaded projections.

12. The container lid of claim 11, wherein a rotation of the dial causes the first threaded projections to rotate around the hollow threaded shaft, resulting in the upper straw being urged towards the plug of the hollow threaded shaft.

13. The container lid of claim 1, wherein the upper straw, the hollow threaded shaft, and the lower straw are concentric.

14. The container lid of claim 1, wherein the dial comprises a knurled outer surface.

15. A beverage container comprising:

a container body comprising an inner surface, an upper portion of the inner surface comprising a plurality of threaded recesses;

a container lid according to claim 1, the container lid comprising a plurality of threaded projections on an outside surface thereof;

wherein the threaded recesses of the container body and the threaded projections of the container lid are in a mating configuration.

16. The beverage container of claim 15, wherein:

a lower portion of the inner surface of the container body defines a hollow space configured to provide thermal insulation to an inside portion of the container body.

* * * * *